US007706561B2

(12) United States Patent
Wilmink et al.

(10) Patent No.: US 7,706,561 B2
(45) **Date of Patent: *Apr. 27, 2010**

(54) ELECTROACOUSTIC TRANSDUCER WITH A DIAPHRAGM AND METHOD FOR FIXING A DIAPHRAGM IN SUCH TRANSDUCER

(75) Inventors: Engbert Wilmink, Delft (NL); Aart Zeger van Halteren, Hobrede (NL); Hendrik Dolleman, Assendelft (NL); Paul Christiaan van Hal, Amsterdam (NL)

(73) Assignee: Sonion Nederland B.V., Amsterdam (NL)

( * ) Notice: Subject to any disclaimer, the term of this patent is extended or adjusted under 35 U.S.C. 154(b) by 1441 days.

This patent is subject to a terminal disclaimer.

(21) Appl. No.: 11/003,811

(22) Filed: Dec. 3, 2004

(65) Prior Publication Data

US 2005/0111688 A1 May 26, 2005

Related U.S. Application Data

(63) Continuation-in-part of application No. 09/958,510, filed as application No. PCT/NL00/00223 on Apr. 5, 2000, now Pat. No. 7,110,565.

(30) Foreign Application Priority Data

Apr. 6, 1999 (NL) ..... 1011733

(51) Int. Cl.
*H04R 25/00* (2006.01)

(52) U.S. Cl. ..... 381/398; 381/418; 381/324

(58) Field of Classification Search ..... 381/396, 381/398, 409, 410, 417, 418, 423, 426, 322, 381/324, 328; 29/594, 609.1; 181/157, 171, 181/172

See application file for complete search history.

(56) References Cited

U.S. PATENT DOCUMENTS

| | | | | |
|---|---|---|---|---|
| 2,794,862 | A | 6/1957 | Tøpholm | |
| 3,560,667 | A | 2/1971 | Carlson | |
| 3,573,397 | A | 4/1971 | Sawyer et al. | |
| 3,588,383 | A | 6/1971 | Carlson et al. | |
| 3,684,052 | A * | 8/1972 | Sotome | 381/398 |
| 3,742,156 | A | 6/1973 | Broersma | |
| 3,935,398 | A | 1/1976 | Carlson et al. | |
| 4,109,116 | A | 8/1978 | Victoreen | |
| 4,122,314 | A * | 10/1978 | Matsuda et al. | 381/425 |
| 4,272,654 | A | 6/1981 | Carlson | |

(Continued)

FOREIGN PATENT DOCUMENTS

| | | |
|---|---|---|
| EP | 0 354 698 | 2/1990 |

(Continued)

*Primary Examiner*—Huyen D Le
(74) *Attorney, Agent, or Firm*—Nixon Peabody LLP

(57) ABSTRACT

Apparatus and method for manufacturing an electroacoustic transducer for, for instance, a hearing aid, with a diaphragm arranged in a housing. The diaphragm is attached onto a film or punched from a sheet of material, such that along the circumferential edge of the diaphragm, a free strip of film or a strip of material remains present, in a capillary space between the circumferential edge of the film and the inner wall of the housing, or in a capillary space between the diaphragm and the strip of material, a polymer of a low viscosity is provided to connect to diaphragm with the housing wall. Through the method, the production of the transducer is greatly simplified.

6 Claims, 7 Drawing Sheets

U.S. PATENT DOCUMENTS

| | | | | |
|---|---|---|---|---|
| 4,312,118 | A | 1/1982 | Saik et al. | |
| 4,410,769 | A | 10/1983 | Tibbetts | |
| 4,728,934 | A | 3/1988 | Pfänder et al. | |
| 5,220,612 | A | 6/1993 | Tibbetts | |
| 5,748,759 | A * | 5/1998 | Croft et al. | 381/398 |
| 6,078,677 | A | 6/2000 | Dolleman et al. | |
| 7,110,565 | B1 * | 9/2006 | Engbert et al. | 381/418 |
| 7,492,919 | B2 * | 2/2009 | Engbert et al. | 381/418 |

FOREIGN PATENT DOCUMENTS

| | | |
|---|---|---|
| EP | 0 851 710 A1 | 7/1998 |
| GB | 2 229 339 | 9/1990 |

* cited by examiner

ELECTROACOUSTIC TRANSDUCER WITH A DIAPHRAGM AND METHOD FOR FIXING A DIAPHRAGM IN SUCH TRANSDUCER

CROSS-REFERENCE TO RELATED APPLICATION

The present application is a continuation-in-part of U.S. patent application Ser. No. 09/958,510, filed Jan. 23, 2002 now U.S. Pat.No. 7,110,565, entitled "Electroacoustic Transducer With A Diaphragm And Method For Fixing A Diaphragm In Such Transducer," which is the National Phase Filing of International Application No. PCT/NL00/00223, filed Apr. 5, 2000, now published as WO 00/60902 on Oct. 12, 2000, which claims priority to NL1011733, filed Apr. 6, 1999.

FIELD OF THE INVENTION

The invention relates generally to an electroacoustic transducer, and, more particularly to methods and apparatuses for fixing a diaphragm to an electroacoustic transducer.

BACKGROUND OF THE INVENTION

Such a transducer is known from U.S. Pat. No. 6,078,677, entitled "Electroacoustic Transducer With Improved Diaphragm Attachment," and finds application especially in hearing aids.

For the proper functioning of such a transducer, various requirements are imposed on the construction of, inter alia, the diaphragm. On the one hand, the diaphragm must be able to move freely, on the other hand it is, of course, necessary to secure the diaphragm somehow. It is therefore customary to attach the diaphragm by its circumferential edge to a support frame or to the case, whereby the central portion of the diaphragm remains unattached in order to be able to vibrate. Often, between this central diaphragm portion and the edge portion, a transition portion is formed as a groove, or bellows are included to give the central diaphragm portion as much freedom of vibration as possible.

Alternatively, the edge portion can be omitted from the design, and a transition portion between the case and the diaphragm can allow for both attachment of the diaphragm to the case and freedom of vibration.

From U.S. Pat. No. 6,078,677, it is also known to attach the diaphragm to a film, which film is attached to the case. To this end, the film can be folded to enable free movement of the diaphragm. A complete suspension of the diaphragm is necessary to obtain proper acoustic separation between the volume in the transducer above and under the diaphragm.

As already mentioned, an acoustic transducer is applied in, for instance, hearing aids, intended to be positioned in the exterior auditory canal of a person. Hence, there is, within this technical field, a continuous pursuit of ever increasing miniaturization, demanding a great sensitivity of the various applied parts.

Apart from this pursuit of miniaturization, it is desired to enlarge the volume displacement by the diaphragm as much as possible, to which end it is desired that the central diaphragm portion be as large as possible.

A drawback of all hitherto proposed manners of connecting a diaphragm to the case is the necessity of different production steps, each involving the possible occurrences of errors, which sometimes can and sometimes cannot be corrected, but always entail additional activities and hence additional costs.

SUMMARY OF THE INVENTION

The present invention provides transducers of the present type and methods for the production thereof, in which the aforementioned drawbacks do not occur. To this end, in a first exemplary embodiment, the invention is characterized in that the diaphragm is provided on a film, in such a manner that along at least a part of the circumferential edge of the diaphragm a free strip of film is present, and that between the circumferential edge of the film and the inner case wall a capillary space is present in which a polymer is provided as a connection between the circumferential edge and the inner case wall.

The invention also provides a method for fitting a diaphragm in a case of a transducer of the above-described type, characterized in that the diaphragm is attached to a film, in such a manner that along the circumferential edge of the diaphragm a free strip of film, which may be bent, remains present and that in a capillary space between the circumferential edge of the film and the inner case wall a polymer of low viscosity is provided to connect the film edge to the case wall.

The present invention has the advantage that the connection between the case and the diaphragm can be very elastic and therefore increases resistance to deformation or tearing even in the case of extensive deflections during operation. Also, the attachment is completely free of tension, which is very favorable to the acoustic properties of the diaphragm.

The polymer used should in any case have the property that it does not evaporate, does not influence the frequency response of the diaphragm, and is also able to resist particular strains. Polymers meeting these requirements are, for instance, polybutenes of different viscosities.

The second embodiment of the invention is characterized in that the diaphragm comprises a central portion and a circumferential edge located in the same plane, spaced apart from the outer edge of the central portion, the central portion and the circumferential edge being made from the same material and being connected to each other by at least one strip likewise consisting of this same material, and that between the circumferential edge of the diaphragm and the outer edge a capillary space is present in which a polymer is provided as a connection.

Additionally, the invention further provides a method characterized in that a diaphragm is formed from a sheet-like material, having a central portion and a circumferential edge located at a capillary distance from the central portion, while between the central portion and the circumferential edge at least one connecting strip is present and that in the capillary space between the central portion and the circumferential edge a flexible polymer is provided.

This second embodiment has the further advantage that the number of process steps is reduced; that errors can more easily be corrected, in particular before the polymer is provided, and that the diaphragm is suspended very flexibly from the circumferential edge, which is connected to the case, so that forming the suspension, as when a film is used, is no longer necessary. Furthermore, in this embodiment, the diaphragm can be manufactured inexpensively in mass production by means of punching. Automatic assembly of the diaphragm is equally possible.

Variations of the above embodiments are also provided. For example, the diaphragm may be bent or not bent and connected to an inner wall of a case via a polymer. Alternately, the diaphragm may be sandwiched between lid and dish portions of the case. A recess or ledge may be formed in a wall of the case, and the diaphragm positioned in the recess.

In embodiments in which the diaphragm includes an edge portion, the edge portion may be connected to the inner wall of the case, it may be sandwiched between lid and dish portions of the case, or it may be positioned in a recess formed in an inner wall of the case. In embodiments having a film, the film may be sandwiched between lid and dish portions of the case without the use of polymer. The film may include a groove in which an optional polymer may be provided. Finally, any of the foregoing embodiments may include a wire that passes through the polymer to provide electrical connectivity between the transducing element and the working electronics.

The invention will be further elucidated below on the basis of an exemplary embodiment with reference to the drawings.

The above summary of the present invention is not intended to represent each embodiment, or every aspect, of the present invention. Additional features and benefits of the present invention will become apparent from the detailed description, figures, and claims set forth below.

Figure 1:
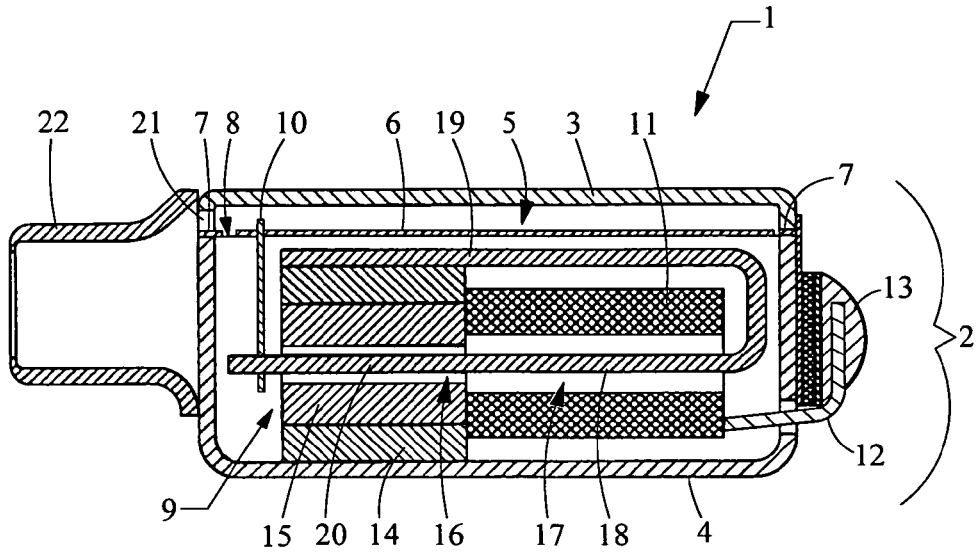
FIG. 1 is a cross-sectional elevation of a transducer with a diaphragm.

While the invention is susceptible to various modifications and alternative forms, specific embodiments will be shown by way of example in the drawings and will be desired in detail herein. It should be understood, however, that the invention is not intended to be limited to the particular forms disclosed. Rather, the invention is to cover all modifications, equivalents and alternatives falling within the spirit and scope of the invention as defined by the appended claims.

DETAILED DESCRIPTION OF THE ILLUSTRATED EMBODIMENTS

The electroacoustic transducer 1 comprises a case 2 consisting of two parts, namely a first case part 3 and a second case part 4. The case 2 is generally shaped as a rectangular box, and the two case parts 3 and 4 generally have a substantially U-shaped cross section, the concave sides of the case parts 3 and 4 facing one another and, when assembled, enclosing the interior of the case 2. In the following, the first case part 3 will also be designated by the term "lid" and the second case part 4 will also be designated by the term "dish."

A diaphragm 5 is positioned in the interior of the case 2. The diaphragm 5 has a central diaphragm portion 6 and an edge portion 7 extending therearound, intended for fixing the diaphragm 5 to the case 2. Between the central diaphragm portion 6 and the edge portion 7, the diaphragm 5 has a transition portion 8, which may be shaped as a pattern of folds.

Mounted on the dish 4 is an actuator 9, which is coupled by means of a movement transmission member 10, also referred to as a "fork," to the central diaphragm portion 6. Actuators and forks for use in miniature transducers are well known in the art, and the present invention contemplates that any suitable actuator or fork known to those skilled in the relevant art may be used.

Since the nature and construction of the actuator 9 are well within the knowledge of the skilled person, and use can be made of an actuator known per se, these aspects will only be described briefly. The actuator 9 comprises an electric coil 11 connected by means of an electric wire 12 extending through the dish 4 to terminals 13 mounted on the outer surface of the case 2. In a magnet housing 14 a magnet element 15 is arranged. An air gap 16 of the magnetic element 15 is aligned with an air gap 17 of the coil 11. A U-shaped armature 18 has a first leg 19 connected to the magnet housing 14 and a second leg 20 extending in the air gaps 16 and 17, which are in alignment with each other. Connected to the end of the second armature leg 20 is the fork 10.

When an externally generated current is presented to the coil 11, a force is applied to the armature 18 by an interaction between the fields generated by the magnetic element 15 and the coil 11. Thus, a displacement is generated in the longitudinal direction of the fork 10 causing the diaphragm to vibrate, generating a pressure wave.

The lid 3 has an opening 21, through which the interior of the case 2, located between the lid 3 and the diaphragm 5, communicates with the exterior world. Connected to the case is a substantially cylindrical snout 22, to which, if so desired, a flexible tube can be connected for conducting pressure waves.

As shown in FIG. 1, in the electroacoustic transducer 1, the edge portion 7 of the diaphragm 5 is positioned in a plane parallel to the plane defined by the central diaphragm portion 6.

The edge portion 7 of the diaphragm 5 is fixed, for instance by way of gluing, to the free end edges of the side walls of the dish 4. These free end edges define a surface which is suitable for attaching the edge portion 7 of the diaphragm 5, and whose width is defined by the thickness of the side walls of the dish 4. Such method of connecting the diaphragm is known from U.S. Pat. No. 6,078,677.

According to some embodiments, a flexible polymer can be provided in a capillary space 8 between (a) the circumferential edge 7 of the diaphragm 5 and the central diaphragm portion 6 of the diaphragm 5 to attach the circumferential edge 7 to the central diaphragm portion 6 or between (b) the circumferential edge 7 and the central diaphragm portion 6 to attach the central diaphragm portion 6 to the circumferential edge 7 and to the inner wall of the second case part 4 when the circumferential edge 7 is flush against the inner wall.

Figure 7:
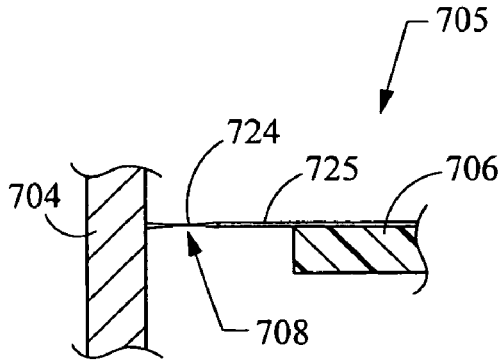
FIG. 7 is a partial cross-sectional view of the electroacoustic transducer assembly with a film attachment according to an embodiment of the invention.

In an embodiment of the invention, the central diaphragm portion 6 is attached to a film and a polymer is provided in a capillary space between the outer edge of the film and the case wall. This embodiment is illustrated in FIG. 7, described in further detail below.

Figure 2:
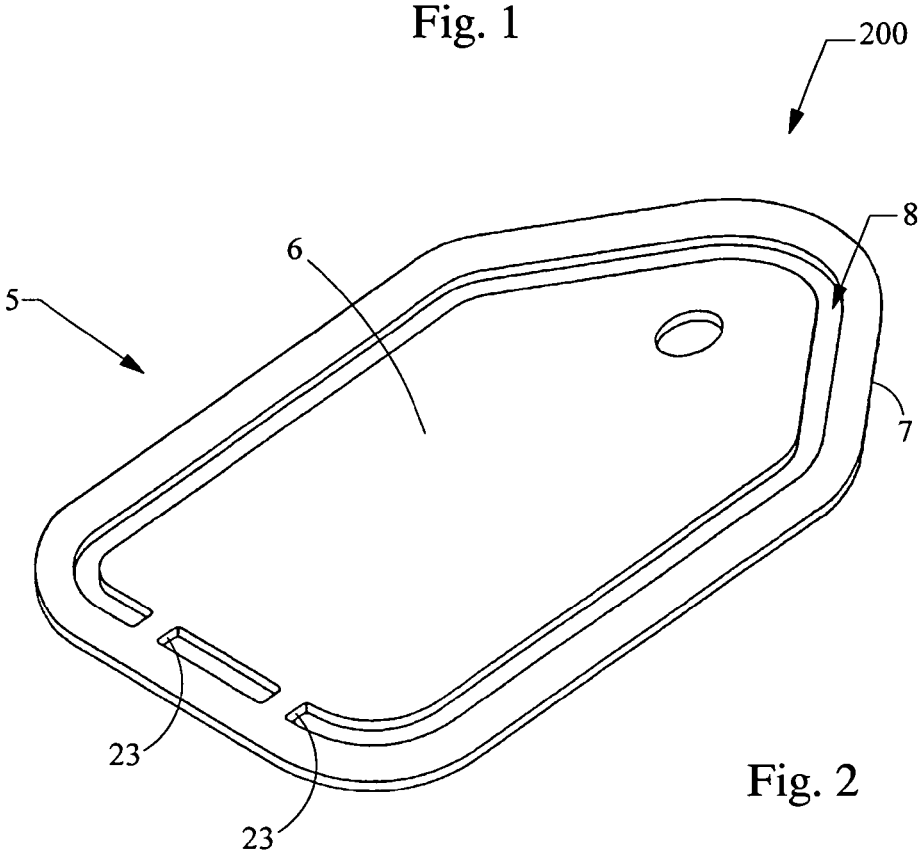
FIG. 2 is a perspective view of the diaphragm according to an embodiment of the invention.

FIG. 2 schematically shows a diaphragm according to another embodiment of the invention, which can be applied in the transducer according to FIG. 1. The central diaphragm portion 6 and the circumferential edge 7 are connected to one another by means of one or more connecting strips or bridges 23. The diaphragm 5 can be simply punched out of a sheet of material, for instance aluminum. The central diaphragm portion 6 is freely moveable relative to the circumferential edge 7. In the capillary interspace 8 the flexible polymer is provided. In this embodiment, the diaphragm can, if so desired, be connected with its edge portion between the free end edges of the lid 3 and dish 4.

Figure 3A:
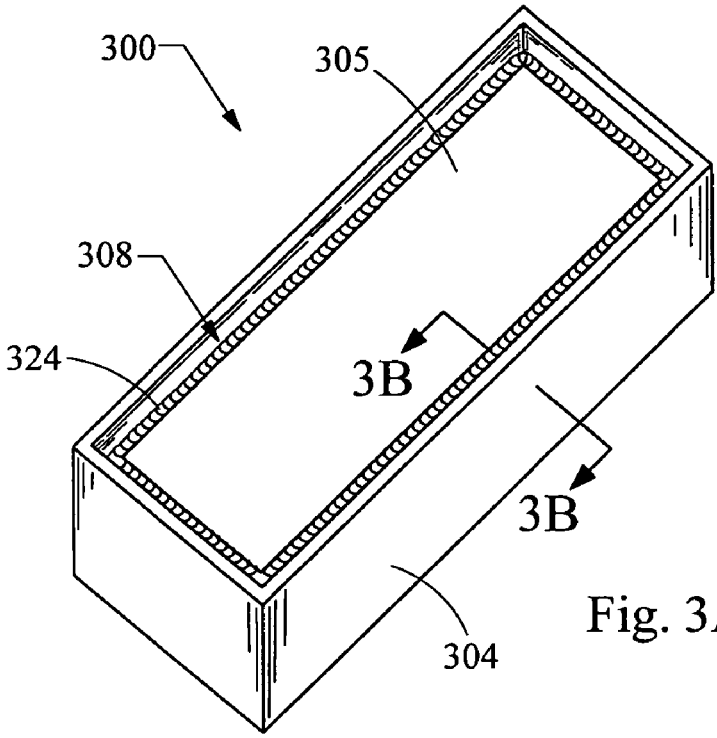
FIG. 3A is a perspective view of a electroacoustic transducer assembly according to an embodiment of the invention.
Figure 3B:
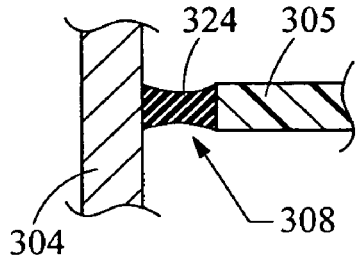
FIG. 3B is a partial cross-sectional view of the electroacoustic transducer assembly according to an embodiment of the invention.
Figure 6A:
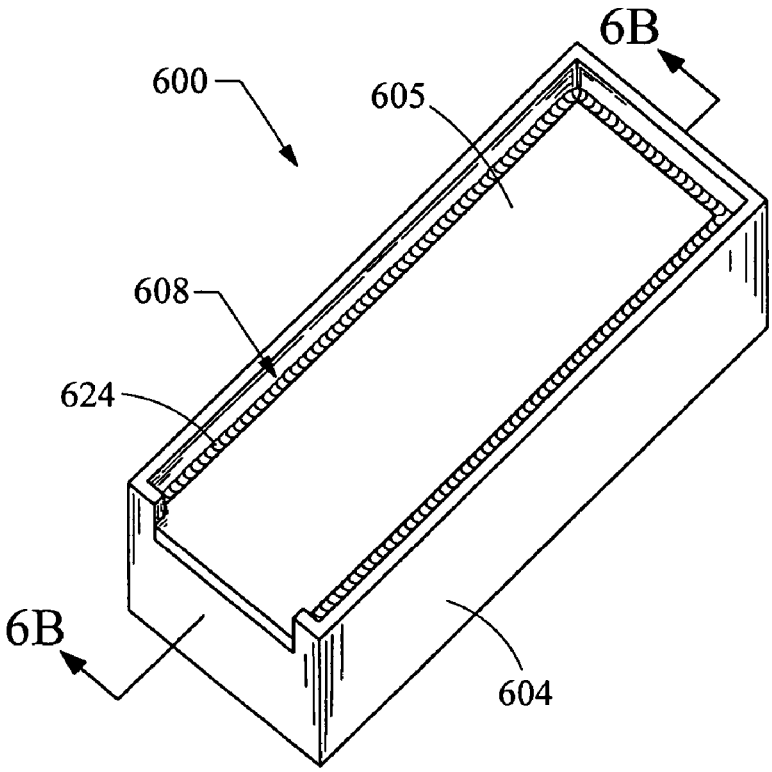
FIG. 6A is a perspective view of the electroacoustic transducer assembly according to an embodiment of the invention.

FIGS. 3A and 3B illustrate perspective and partial cross-sectional views of an electroacoustic transducer assembly 300 that includes a second case part 304 and a diaphragm 305. The shape of the transducer assembly 300 is shown as rectangular for ease of illustration, however, the shape can be any conventional shape. Also for ease of illustration, the well-known working parts and other features shown in FIG. 1 of the transducer assembly 300 are omitted. As illustrated, the second case part 304 has a generally U-shaped cross-section. The diaphragm 305 is positioned in the interior of the second case part 304. A flexible polymer 324, such as polybutene, is provided in a capillary space 308 between the diaphragm 305 and the inner wall of the second case part 304 to attach the diaphragm 305 to the second case part 304. Examples of suitable polymers are provided below. As shown, the flexible polymer 324 extends all the way around the diaphragm 305, but in other embodiments, the polymer 324 may extend only partially around the diaphragm 305 (such as shown in FIG. 6A). Sufficient polymer 324 should be applied to permit the diaphragm 305 to freely move within the second case part 304 without breaking loose from its polymeric connection with the inner wall.

Figure 4:
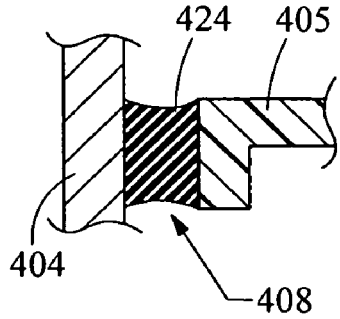
FIG. 4 is a partial cross-sectional view of the electroacoustic transducer assembly according to an embodiment of the invention.

FIG. 4 varies from the previous configuration in that the diaphragm 405 has a bent outer edge. A flexible polymer 424 is provided in a capillary space 408 between the bent edge of the diaphragm 405 and the second case part 404 to attach the diaphragm 405 to the second case part 404.

Figure 5:
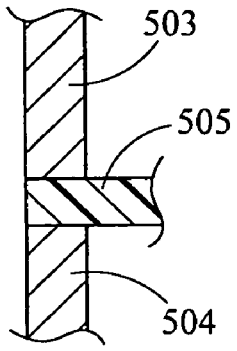
FIG. 5 is a partial cross-sectional view of an electroacoustic transducer assembly according to an embodiment of the invention.

FIG. 5 shows a portion of a diaphragm 505 being received directly between a first case part 503 and a second case part 505 without the use of polymer. This type of connection can be used to connect an edge of the diaphragm 505 to the case, such as shown in FIG. 6A.

Figure 6B:
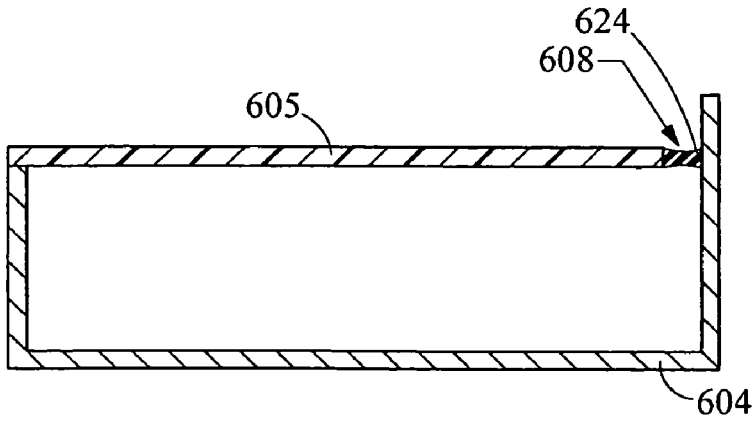
FIG. 6B is a cross-sectional view of the electroacoustic transducer assembly according to an embodiment of the invention.

FIG. 6A depicts an electroacoustic transducer assembly 600 having a cutout at one of the longitudinal ends of a second case part 604 for receiving a diaphragm 605. At this end, one end of the diaphragm 605 is disposed above the cutout of the second case part 604 as shown in FIG. 6B. On the other sides of the circumferential edge of the diaphragm 605 a polymer 624 exists in a capillary space 608 between the second case part 604 and the circumferential edge of the diaphragm 605. A lid or first case part (not shown) is disposed over the cutout of the second case part 604, in such a manner as shown by the first case part 503 in FIG. 5.

Figure 6C:
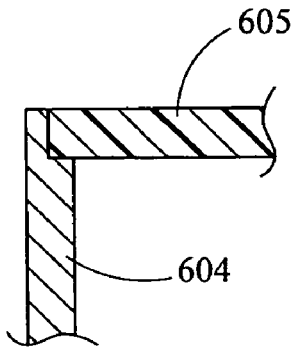
FIG. 6C is a partial cross-sectional view of the electroacoustic transducer assembly according to an embodiment of the invention.

FIG. 6C differs from the previous configurations in that the diaphragm 605 is received within a recessed ledge of the second case part 604 on one end of the assembly 600. A polymer is disposed in the capillary space 608 between the second case part 604 and the diaphragm 605 on the other sides of the diaphragm 605 not connected to the recessed ledge of the second case part 604.

Figure 8:
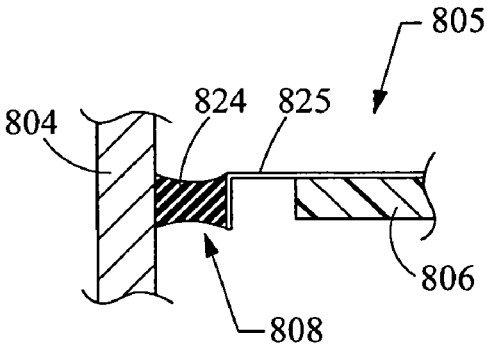
FIG. 8 is a partial cross-sectional view of the electroacoustic transducer assembly with a film attachment according to an embodiment of the invention.
Figure 9:
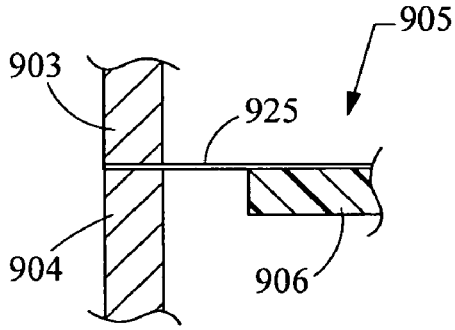
FIG. 9 is a partial cross-sectional view of an electroacoustic transducer assembly with a film attachment according to an embodiment of the invention.

FIGS. 7-10 add a film to the diaphragm. FIG. 7 depicts a diaphragm 705 having a central diaphragm portion 706 attached to a film 725. A polymer 724 is provided in a capillary space 708 between the outer edge of the film 725 and the second case part 704. The polymer connection may extend all the way around the outer edge of the film 725 or only extend partially around. For example, one end of the film 725 may be connected to the second case part 704 as shown in FIG. 7 while another end of the film is connected to the second case part 704 as shown in FIG. 9.

FIG. 8 varies from the previous configuration in that a film 825 is bent along at least a portion of its outer edge and attached to a central diaphragm portion 806. A polymer 824 is provided in a capillary space 808 between the bent outer edge of the film 825 and the second case part 808.

FIG. 9 depicts a diaphragm 905 having a central diaphragm portion 906 attached to a film 925. At least an outer portion of the film 925 is sandwiched between the first case part 903 and the second case part 904.

Figure 10:
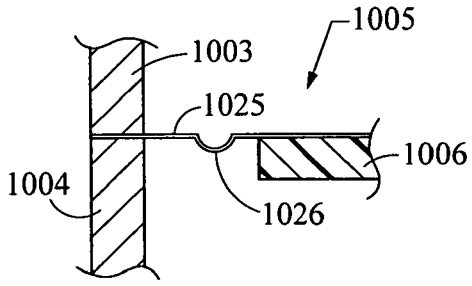
FIG. 10 is a partial cross-sectional view of an electroacoustic transducer assembly with a film attachment according to an embodiment of the invention.

FIG. 10 adds a groove or fold 1026 to a film 1025 between a central diaphragm portion 1006 and the portion of film 1025 sandwiched between the first and second case 1004. The groove 1026 is adapted to provide suitable freedom of movement of the central diaphragm portion 1006.

Figure 11A:
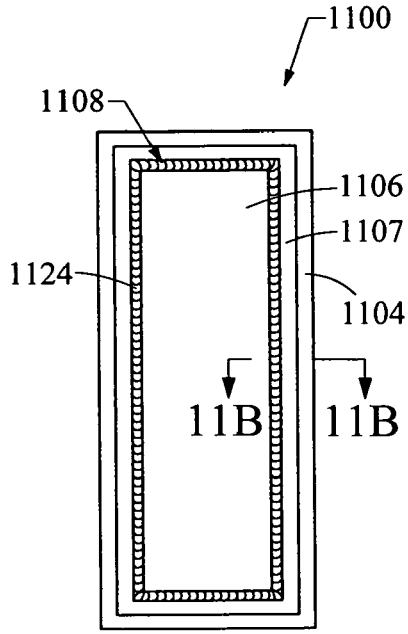
FIG. 11A is a sectional top view of an electroacoustic transducer assembly with an edge portion according to an embodiment of the invention.
Figure 11B:
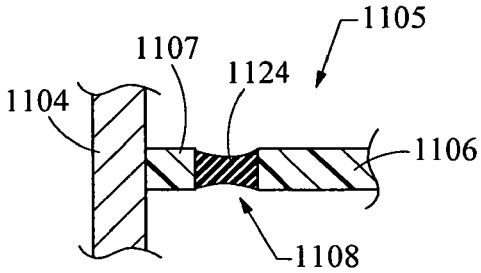
FIG. 11B is a partial cross-sectional view of an electroacoustic transducer assembly with an edge portion according to an embodiment of the invention.

FIGS. 11A and 11B depict an electroacoustic transducer assembly 1100 having a second case part 1104 and a diaphragm 1105 disposed within the second case part 1104. An edge portion 1107 of the diaphragm 1105 extends therearound and is fixed to the second case part 1104 as shown in FIG. 11B. The diaphragm 1105 also has a central diaphragm portion 1106, and between the central diaphragm portion 1106 and the edge portion 1107 exists a capillary space 1108. Within this capillary space is a polymer 1124, which attaches the central diaphragm portion 1106 to the edge portion 1107.

Figure 12:
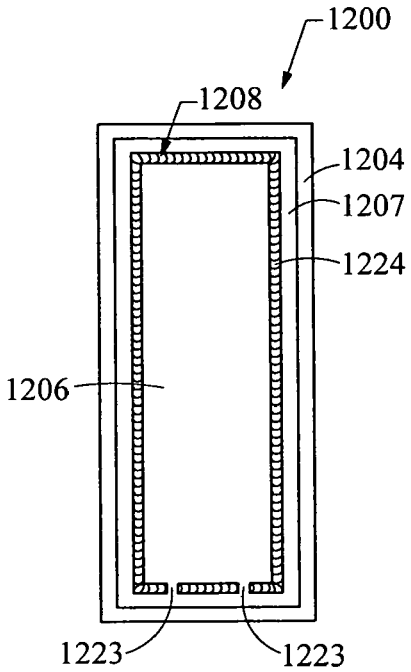
FIG. 12 is a sectional top view of an electroacoustic transducer assembly with an edge portion according to an embodiment of the invention.

FIG. 12 is similar to FIG. 11A, except that FIG. 12 shows connecting strips or bridges 1223 connecting together a central diaphragm portion 1206 and an edge portion 1207. A capillary space 1208 exists between the central diaphragm portion 1206 and the edge portion 1207, and a polymer 1224 is provided in the capillary space 1208.

Figure 13A:
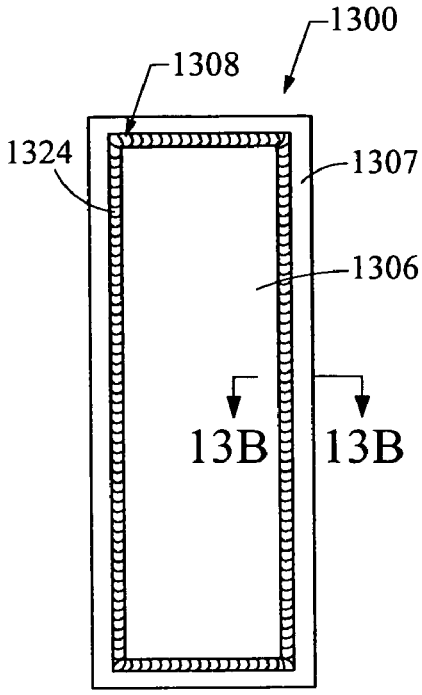
FIG. 13A is a sectional top view of an electroacoustic transducer assembly with an edge portion according to an embodiment of the invention.
Figure 13B:
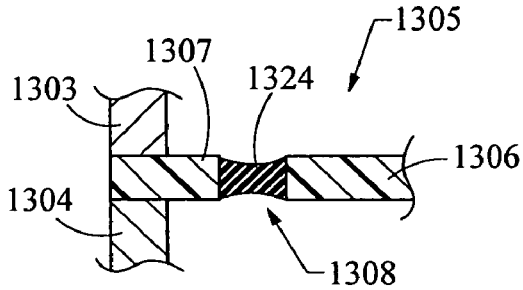
FIG. 13B is a partial cross-sectional view of an electroacoustic transducer assembly with an edge portion according to an embodiment of the invention.

FIGS. 13A and 13B depict an edge portion 1307, of which an outer perimeter portion is located between a first case part 1303 and a second case part 1304, instead of being attached against the second case part as shown in FIG. 1B. A central diaphragm portion 1306 of a diaphragm 1305 is connected to the edge portion 1307 via a polymer 1324.

Figure 14:
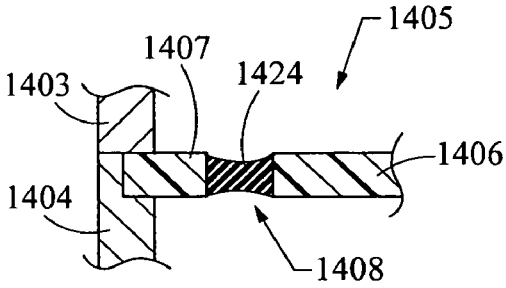
FIG. 14 is a partial cross-sectional view of an electroacoustic transducer assembly with an edge portion according to an embodiment of the invention.

FIG. 14 adds a recessed ledge in a second case part 1404 that receives an outer perimeter portion an edge portion 1407 of a diaphragm 1405. A first case part 1403 is placed over the second case part 1404, securing the diaphragm 1405. A polymer 1424 is provided in a capillary space 1408 between the edge portion 1407 and a central diaphragm portion 1406 of the diaphragm 1405. In an embodiment, connecting strips or bridges may connect the edge portion 1407 with the central diaphragm portion 1406.

Figure 15:
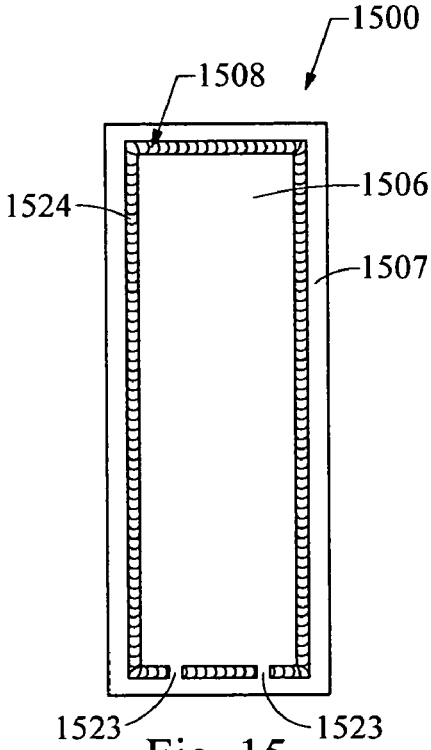
FIG. 15 is a sectional top view of an electroacoustic transducer assembly with an edge portion according to an embodiment of the invention.

FIG. 15 is similar to FIGS. 13A and 13B, except that it depicts one or more connecting strips or bridges 1523 which connect an edge portion 1507 to a central diaphragm portion 1506 of an electroacoustic transducer assembly 1500. A capillary space 1508 exists between the central diaphragm portion 1506 and the edge portion 1507, except at the connecting strips or bridges 1523. A polymer 1524 is provided in the capillary space to allow flexible freedom of movement of the central diaphragm portion 1506 during vibration.

Figure 16:
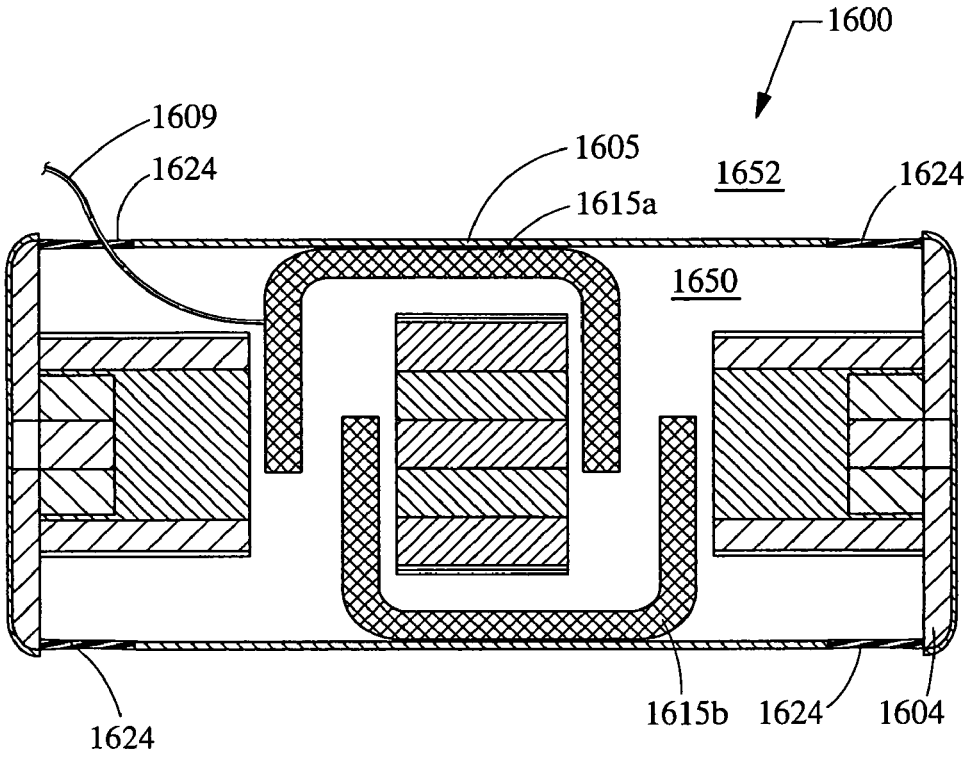
FIG. 16 is a cross-sectional view of an electroacoustic transducer with a wire connection according to an embodiment of the invention.

FIG. 16 generally depicts an electroacoustic transducer 1600 having a wire 1609 passing through a suspension polymer 1624 from a non-coil volume 1652 to a coil volume 1650. The electroacoustic transducer 1600 is of the moving coil type such as described in U.S. Patent Application Publication No. 2003/0048920, entitled "Electro-Acoustic Transducer With Two Diaphragms," published Mar. 13, 2003, and includes two moving coils 1615*a*, 1615*b*. Numerous components of the transducer 1600 occupy the coil volume 1650, and it is therefore desirable to have the coil wire connections to the audio processing electronics run through the non-coil volume as much as possible. In the embodiment shown in FIG. 16, the polymer is provided between a diaphragm 1605 and the inner wall of a first case portion 1604, and the wire 1609 is run through the polymer 1624 on the side most proximate to the coil 1615*a* so that wire travel within the coil volume 1650 is minimized. It should be understood that the wire 1609 may be passed through a polymer in any of the embodiments shown and described in connection with FIGS. 1-15.

It should be noted that each of the foregoing embodiments can be implemented in a microphone or a receiver. As mentioned above, embodiments described herein have the advantage that the connection between the case and the diaphragm can be very elastic and therefore increases resistance to deformation or tearing even in the case of extensive deflections during operation. Also, the attachment is completely free of tension, which is very favorable to the acoustic properties of the diaphragm.

The polymer used in the embodiments described herein should have the property that it does not evaporate, does not influence the frequency response of the diaphragm, and is also able to resist particular strains. The polymer can be heat cured or UV-light cured. Polymers meeting these requirements are, for instance, polybutenes of different viscosities. For example, two exemplary Brand Dielectric Gel polymers commercially available from Dow Corning suitable for use with the present invention are: (1) Standard Gel, type 3-4170 Dielectric Gel, two-part, heat cure, viscosity 450 centipoise; (2) Standard Gel, type X3-6211 Encapsulant, two-part, UV cure, viscosity 930 centipoise.

While the invention is susceptible to various modifications and alternative forms, specific embodiments have been shown by way of example in the drawings and described in detail herein. It should be understood, however, that the invention is not intended to be limited to the particular forms disclosed. Rather, the invention is to cover all modifications, equivalents and alternatives falling within the spirit and scope of the invention as defined by the appended claims.

What is claimed is:

1. An electroacoustic transducer assembly, comprising:

a case having a first portion and a second portion;

a diaphragm having an outer circumferential edge;

a polymer;

a film attached to said diaphragm, said film having an outer edge extending beyond at least a portion of said outer circumferential edge of said diaphragm, and between said outer edge of said film at said portion of said outer circumferential edge and an inner wall of said case a capillary space is present in which said polymer is provided for connecting said outer edge of said film to said inner wall, said polymer increasing resistance to deformation of said diaphragm when in operation; and means for converting between an electric signal and a vibration of said diaphragm.

2. The electroacoustic transducer assembly of claim 1, wherein said outer circumferential edge of said film is bent.

3. The electroacoustic transducer assembly of claim 1, further comprising a wire positioned to pass through said polymer, said wire carrying said electric signal.

4. The assembly of claim 1, wherein said film extends beyond said diaphragm around the entire outer circumferential edge of said diaphragm and said polymer is present between the entire outer edge of said film and said inner wall.

5. The assembly of claim 4, wherein said outer edge is bent.

6. The assembly of claim 1, wherein another outer edge of said film is sandwiched between said first portion and said second portion of said case.

* * * * *